US005593155A

United States Patent [19]

Fauble et al.

[11] Patent Number: 5,593,155

[45] Date of Patent: Jan. 14, 1997

[54] TRAINING DEVICE FOR RACKET SPORTS

[76] Inventors: Curtis D. Fauble, 2001 Grove Ave., Quincy, Ill. 62301; David L. Fauble, 505 W. High St., Urbana, Ill. 61801

[21] Appl. No.: 527,623

[22] Filed: Sep. 13, 1995

[51] Int. Cl.[6] ..... A63B 69/00

[52] U.S. Cl. ..... 473/463

[58] Field of Search ..... 273/29 A, 73 C

[56] References Cited

U.S. PATENT DOCUMENTS

| | | | |
|---|---|---|---|
| 3,330,560 | 7/1967 | Higdon | 273/73 |
| 3,414,260 | 12/1968 | Gust | 272/57 |
| 3,913,911 | 10/1975 | Peterson | 273/73 C |
| 4,000,893 | 7/1977 | Evans | 273/29 A |
| 4,108,433 | 8/1978 | Althoff | 273/29 A |
| 4,192,505 | 3/1980 | Tabickman | 273/73 C |
| 4,200,285 | 4/1980 | Pettiti | 273/29 A |
| 4,988,100 | 1/1991 | Chu | 273/73 C |
| 5,054,780 | 10/1991 | Chen | 273/73 C |
| 5,083,777 | 1/1992 | Held | 273/73 R |
| 5,286,021 | 2/1994 | Shaw | 273/73 R |

*Primary Examiner*—Theatrice Brown
*Attorney, Agent, or Firm*—Joseph W. Holloway

[57] ABSTRACT

A simulated racket device for developing and conditioning muscles and tendons of a player's hand, wrist and arm. The simulant racket device, when weighted in accordance with the invention, will increase dynamic muscle strength and enhance development of psychomotor skills required for correct racket manipulation and ball striking. An elongated handle is joined at its distal end to the midpoint of a head having a pair of projecting legs which have end segments with weight receptacles connected thereto.

13 Claims, 2 Drawing Sheets

TRAINING DEVICE FOR RACKET SPORTS

BACKGROUND OF THE INVENTION

This invention pertains to simulated racket devices for developing and conditioning certain muscles and tendons of a player's hand, wrist and arm for increased proficiency in executing fundamental strokes of racket sports such as tennis. Utilization of simulant racket devices in accordance with the invention disclosed herein will not only increase a player's dynamic muscle strength, but will enhance development of psychomotor skills required for correct racket manipulation and ball striking during game play.

Prior patents disclose conventionally constructed rackets having supplemental weights attached thereto for developing, toning or loosening those muscles particularly employed for swinging a racket smoothly and forcefully. These previously known devices may have weights attached by one means or another to the perimeter of a racket head as disclosed in U.S. Pat. No. 5,083,777 issued to Held, U.S. Pat. No. 4,200,285 issued to Petitti, U.S. Pat. No. 4,108,433 issued to Althoff, and U.S. Pat. No. 3,330,560 issued to Higdon. Attachment of weights to conventional rackets in the handle or throat area is taught by U.S. Pat. No. 5,286,021 issued to Shaw, U.S. Pat. No. 4,142,721 issued to Faleck, U.S. Pat. Nos. 4,052,061 and 4,005,864 issued to Stewart, and U.S. Pat. No. 4,000,893 issued to Evans.

Each of the rackets disclosed in the cited patents is entirely conventional apart from the means for attaching a weight or weights thereto; and, each has as a paramount object the continued utility of the racket for actual game play. To this end, most of these rackets have specially designed weight attachment means which permit a player to strike a ball with the weights in place. See, for example, the head-mounted attachments of Held, Althoff, and Higdon; and, the throat-mounted attachments of Faleck, Stewart and Evans. While the Petitti and Shaw patents show that their rackets are conventionally constructed and remain playable once their weights are detached, both feature weight attachment means that are to be removed after completion of warm up exercise which involves racket swinging without striking a ball.

The quintessential characteristic of each of the weight-bearing rackets cited hereinabove is that the racket must remain playable once the weights and/or the weight attachment means are dismantled from the racket. This general requirement that a racket serve both as a playable racket and as a weighted exercise, practice, or warmup device is understandable where a player owns but a single racket or wishes to use his exercise racket during actual play. However, hewing strictly to a requirement for convertibility for such dual racket use produces these drawbacks:

1. While the weight attachment means ought to be easily disconnected from the racket, it must, of necessity, have a mechanically positive attachment thereto to avoid unintended, perhaps dangerous, separation when the racket and weight are swung with great force or are suddenly arrested. Moreover, many known racket weighting devices are readily adjustable, or even elastically expansible, to allow their conformation to different portions of the same racket or to rackets of differing shapes and sizes. These conflicting design considerations with respect to previously known weight attachment means tend to produce weighted rackets which are often unhandy to convert, unsafe, or both.

2. Modern tennis rackets are lightly constructed and usually weigh less than one pound. Accordingly, the aggregate amount of weight that can be attached to any playable racket is limited by the ability of the racket to support an added dynamic Load without breaking, bending or suffering other structural damage. Moreover, maximum racket weighting is limited by the strength of the weight attachment means itself and by its ability to avoid displacement, distortion or total disengagement with respect to the racket.

3. The development of weighting devices, other than those used with standard rackets, has been largely thwarted to the detriment of players-, coaches and training professionals who need better, more specialized devices to improve present racket sport development programs and training technics.

Prior U.S. Pat. No. 3,414,260 issued to Gust discloses a weighted exerciser in the form of a tennis racket having its strings removed to accommodate a weight-bearing shaft attached to the racket head in alignment with the longitudinal centerline of the racket handle. In keeping with a stated object of this invention, Gust suggests that weights be applied to the tennis racket without changing its basic construction. Therefore, no matter how cumbersome it might be to do so, it appears that Gust anticipates that his weighted shaft may be dismantled from the head and the racket restrung to restore it to playable condition when it is not used for exercising purposes.

Another general shortcoming of the prior art relevant to weighted rackets results from the single-minded endeaver of inventors of previously known exercise rackets to provide means for attaining general muscular development of a player's arm without addressing certain racket handling and positioning requirements which are essential to good play, but are not necessarily dependent on muscular strength and arm speed. For example, in tennis there is no known training or conditioning device which effectively develops an ability to address and stroke a ball with the flat face or strings of the racket head held in an essentially vertical attitude. Unless this vital racket head orientation is learned and remembered, a player will find it impossible to control the altitude and length of travel of a struck ball with accuracy and consistancy. Racket head verticality is also an essential constituant of the basic forehand stroke which derives great power from drawing the racket strings upwardly as the ball is struck at full racket speed to create overspin or topspin. Likewise, an effective backhand stroke anticipates racket verticality in order to impart to the ball the full impact force created by the player's dynamic muscle strength. Obviously, deviations from racket vertically are purposely made to elevate or depress the travel path of a ball as play may require. However, the desired degree of deviation is nevertheless selected and implemented with reference to vertical racket orientation that is known and remembered by the player.

In view of the aforenoted shortcomings of conventionally weighted rackets, it is believed that a specialized weight conditioning device is needed and should include the following structural and operational features and advantages:

1. The device should have a handle and frame that can be gripped and manipulated in a manner that simulates a conventional racket. Otherwise, the configuration and dimensions of the device need not be constrained by conventional racket parameters.

2. The device should have the capacity to serve the dual purposes of developing beneficial muscularity in the player's hand, wrist and arm and of establishing his sense of racket head position in space, particularly head verticality.

3. The frame portion of the device should include integrally formed or securly attached housing means adapted to receive and capture therein one or more weights.

4. The aggregate weight of the device to be supported by the player's wrist and arm should be made incrementally variable by some ready means such as different sized weights, different weight materials or by the substitution of entire weight assemblies having different minimum and maximum weight capacities.

5. A pair of spaced, weight-receiving housings should be located on the frame of the device at the same radial distance from the longitudinal axis of the handle. The weight placed in the housings may be made unequal so that the force of gravity acting on the weights in each housing will create a resultant moment tending to rotate the handle unless and until the weights are vertically aligned. The hand which grips the handle of the simulated racket will sense either a torque produced by some angular deviation from vertical of the unequal weights or, alternatively, an achieved state of rotational equilibrium wherein the weights are vertically aligned and produce no torque tending to rotate the racket about the handle axis. By this means, the person gripping the handle can sensibly perceive whether the frame is vertical and, if not vertical, he will be signalled if he adjusts the frame toward a more nearly vertical position.

SUMMARY OF THE INVENTION

The general object of this invention is to provide an improved conditioning and training device for racket sports which overcomes the aforementioned deficiencies of presently known devices of this kind and which provides the several structural and operational advantages listed above. Also within the purview of this general object is the provision of a novel training method for enhancing a player's perception of racket head location with respect to a vertical reference position.

Another important object is to provide a simulant tennis racket which is free from restraints commonly imposed on the structural make-up of weighted rackets, particularly the requirement that the racket remain playable. To this end, the present invention comprehends a elongated handle dimensionally similar to a conventional racket handle but joined at its distal end to the midpoint of a curved base of a U-shaped head having a pair of projecting legs spaced laterally from the handle's longitudinal axis which, when extended, bisects the head. The legs have end segments which are generally parallel to one another and have weight receptacles connected to the extreme ends thereof.

Another object is the provision of an improved exercise device and method for developing dynamic muscle strength whereby the player is tasked to swing the simulant racket more or less parallel to the ground while his hand, arm and wrist muscles are stressed to prevent his wrist from pivoting downwardly in response to gravity acting on the aggregate weight carried by the bifurcated legs of the head.

A detailed object is to provide improved means for easily and securely attaching weights to the free ends of the U-shaped head. In accordance with the present invention, this object is realized by providing hollow housings, containers or receptacles which may be integrally formed at the ends of the legs of the U-shaped head or which, if discretely formed, may be attached by a threaded or welded connection or like means. In either case, a weight housing is secured to each leg by mechanically competent means unlikely to become inadvertently detached should the containers be accidently impacted during use of the device. These housings are closed by removable caps, plugs, or like means which are also securely fastened to the housing by interfitting threads.

Yet another detailed object is to provide a weight-holding container suitably constructed to receive and retain plural weights of widely differing sizes and weights. This provision for selectively weighting the simulant racket enhances the development of intensive exercise programs for heavily stressing users' muscles and tendons, the development of less strenuous programs for younger or less muscular players, and also facilitates the alternate use of a single device for muscle building, stroke practicing, or warming up.

A detailed object is to provide a nonconventional, U-shaped head for a simulant racket as described above wherein the leg components of the head and the weight receptacles are both cylindrical in cross section and the weight capacity of the receptacles can be varied very substantially by altering either or both the diameter or length of the receptacles. It is also contemplated that receptacles of different sizes and shapes may be interchangeably attached to the legs.

To obviate annoying and perhaps damaging shifting of the weights included inside an assembly, this invention contemplates that the weights be constrained against unwanted displacement by means of stabilizing springs or elastomeric compression means located within the receptacles.

For reasons to be explained more fully hereinafter, a critical aspect of this invention is the combination of the head, receptacles and weights in such a fashion that the legs can be evenly weighted or alternatively the leg weights can be intentionally made unequal to creat an imbalance which quite unexpectedly enables this weighted racket to be employed in a totally new and beneficial manner for developing racket manipulating skills.

These and other advantages and objects of this invention and the manner of obtaining them will become apparent and the invention will be best appreciated and fully understood by having reference to the following detailed description of the invention taken in conjunction with the accompanying drawings.

DESCRIPTION OF THE PREFERRED EMBODIMENTS

Figure 1:
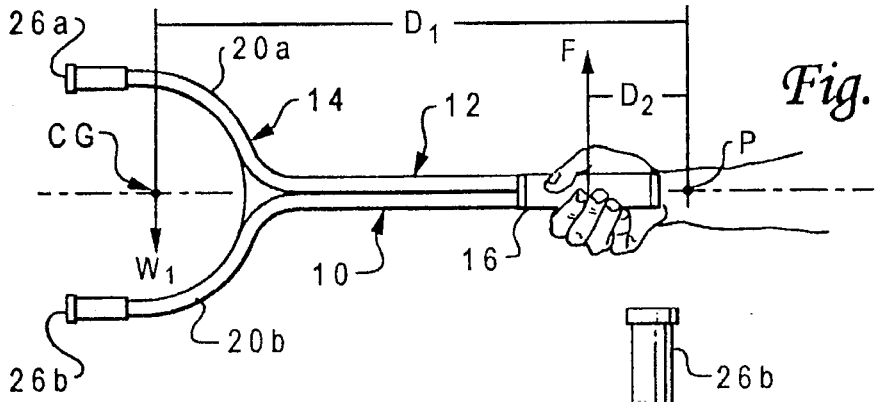
FIG. 1 is an elevational view showing a simulant racket being grasped about its handle by a human hand for swinging the racket horizontially.
Figure 2:
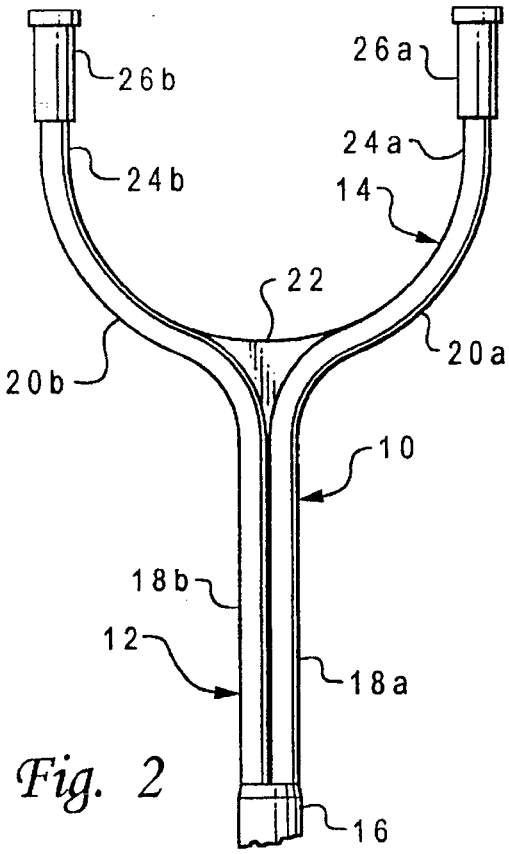
FIG. 2 is an enlarged elevational view of the racket shown in FIG. 1 wherein the handle depends vertically from a U-shaped head which opens upwardly.

As best illustrated in FIGS. 1 and 2, the simulant racket, indicated in its entirety by numeral 10, generally comprises an elongated handle portion 12 and a U-shaped head portion 14. The handle 12 has approximately the same length as a standard racket handle and a conventional hand grip 16 is attached to the gripped or proximal end of the racket. Since this simulant racket is not intended to be playable, its configuration and maerial make-up may be selected solely for superior performance as a dedicated exercise and training device. For example, the handle and frame may be made of steel, alloyed aluminum, or a suitable strong and machinable plastic depending upon the amount of weight the device is required to support, the allowable combined weight of the weight assemblies and the racket, and the severity of service to which the racket may be exposed. Likewise, the entire simulant racket including the handle 12, the head 14 and weight-receiving housings to be discribed could be cast, molded or otherwise fabricated in a single piece to facilitate its mass production at minimum cost.

The illustrative racket employs a pair of cylindrical rods or tubes 18*a* and 18*b* to form the handle 12 and head 14. These rods are shown welded or otherwise bonded together in side by side relationship to form the straight handle portion 12 and are then bent or otherwise formed in the shape of the letter U to provide a pair of divergent legs 20*a* and 20*b*. A strengthening gusset 22 is attached between the legs 20*a* and 20*b* in that area where the legs initially diverge from the handle portion 12. It is perferred that the lateral spacing between the legs be more or less consistant with conventional rackets, but it should be understood that the shape and dimensions of the head may be substantially varied from that shown without prejudice to the operation of this invention and the benefits obtainable therefrom. The distal segments 24*a* and 24*b* of the legs are not curved but are made straight and substantially parallel to one another.

Figure 3:
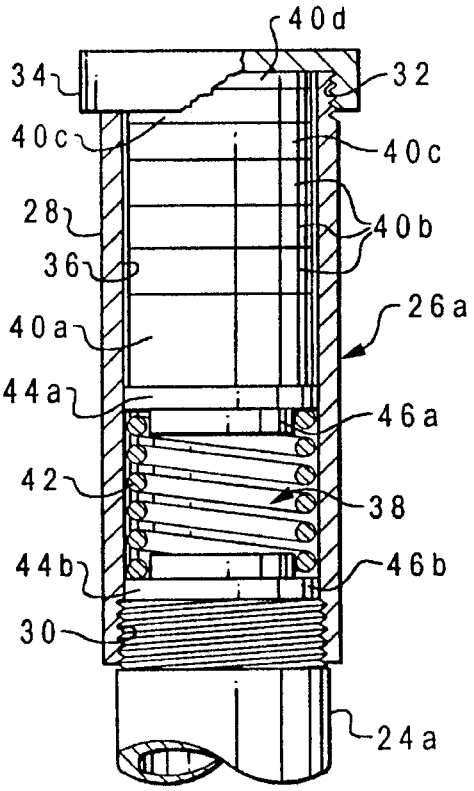
FIG. 3 is a partial sectional view of one of the weight assemblies attached to the divergent legs of the U-shaped racket head shown in FIGS. 1 and 2.
Figure 4:
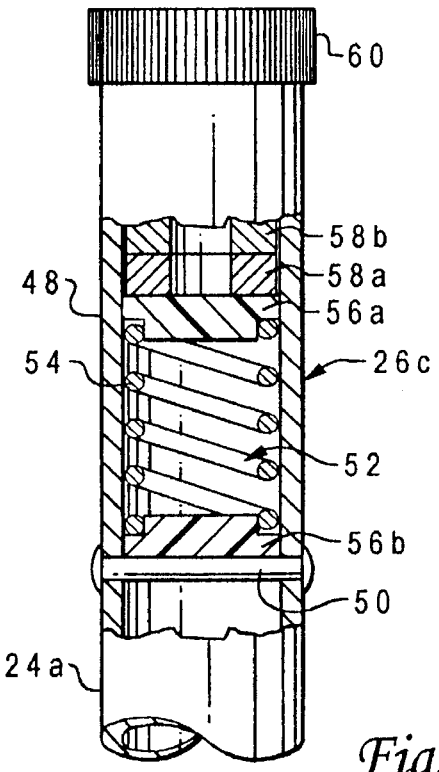
FIG. 4 is a partial sectional view of a first modified weight assembly.
Figure 5:
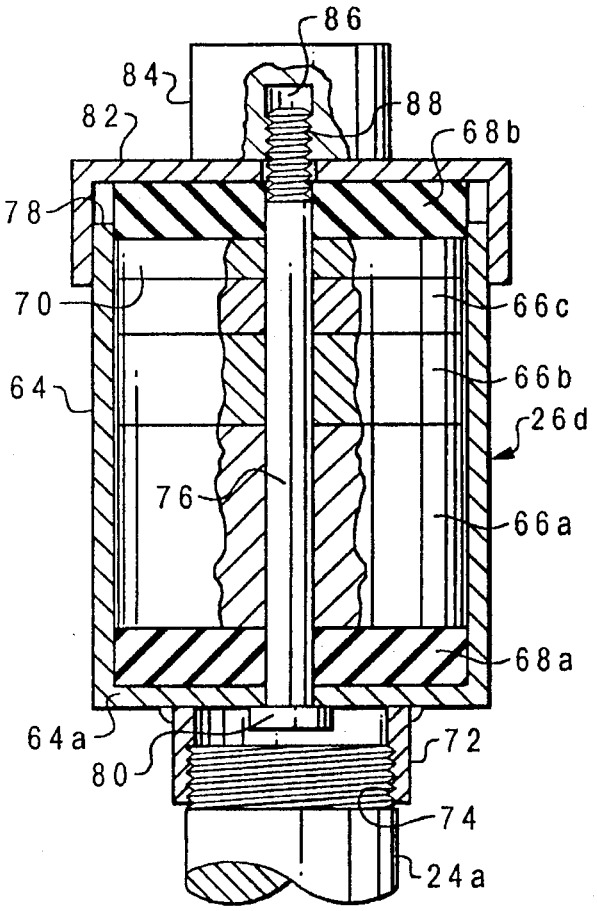
FIG. 5 is a partial sectional view of a second modified weight assembly.
Figure 6:
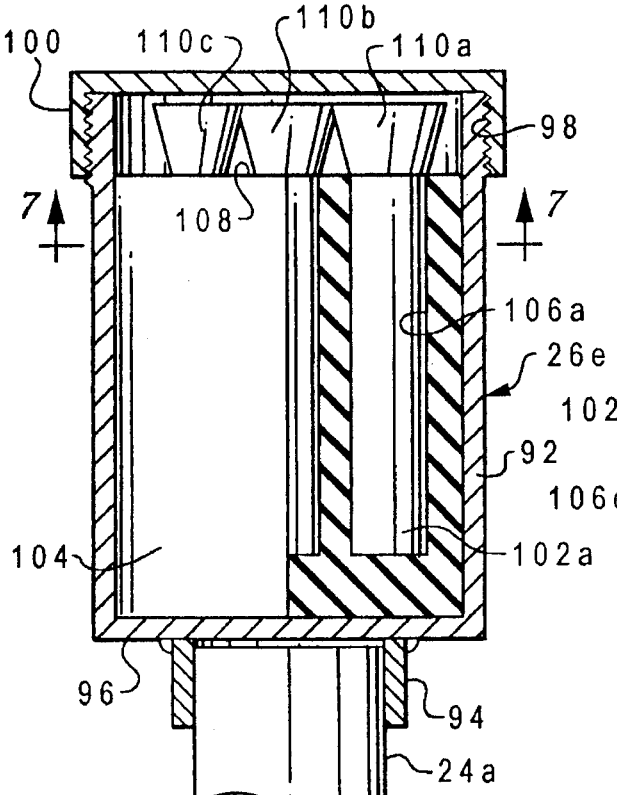
FIG. 6 is a partial sectional view of a third modified weight assembly showing a cylindrical elastomeric member thereof quarter sectioned along lines 6—6 of FIG. 7.

The cylindrical stock utilized for the handle and head may be metal or plastic tubing as shown in FIGS. 3 and 4, or a solid rod, as shown in FIGS. 5 and 6. The handle and head could be molded in a single piece provided the head were bifercated or otherwise formed to provide structure equivalent to the legs 20*a*, 20*b*. Additionally, the handle and head could be fabricated separately of the same or different materials and permanently or detachable joined by suitable means such as welding, bonding or mechanically interfitting and locking means.

Turning now to an essential feature of this invention, FIGS. 1 and 2 show that the parallel distal ends 24*a*, 24*b* of the legs 20*a*, 20*b* each carry like weight assemblies indicated generally at 26*a* and 26*b*. While the weight assemblies according to this invention may take several forms and can be constructed to serve different needs as illustrated by the four illustrative embodiments to be described hereinafter, each weight assembly has these characteristic structural features:

1. A hollow, weight-receiving housing is provided at the distal end of each leg 20*a*, 20*b*.
2. The weight means placed in the housing is retained therein by a closure means removably attached to the outer open end of the housing.
3. The weights are made variable in number, thickness or density whereby each of a pair of housings may carry the same but variable total weight or one housing of a pair may carry a different total weight than the other.
4. Each weight is shaped and sized for easy insertion into and withdrawal from the interior of its housing; and, stabilizing or cushioning means are provided to forstall axial displacement of weights with respect to the housing and closure means and inter-weight displacement where plural weights are employed.

FIG. 3 depicts the structural details of the weight assembly 26*a* shown in FIGS. 1 and 2 which includes an elongated cylindrical sleeve 28 having an inside diameter slightly greater than the outside diameter of the distal end segment 24*a* of the tubular leg 20*a*. The sleeve 28 and leg 20*a* may be made of the same or of different materials so long as each may receive complementary threads whereby a threaded connection 30 is provided to join these elements coaxially. The threaded connection 30 is not only strong and secure, but permits a manufacturer or user to employ different, but similarly threaded, housings such as the substantially enlarged housing 64 shown in FIG. 5, for example. At the outer end of sleeve 28 is a threaded connection 32 which detachably joins the closure cap or lid 34 to the sleeve whereby weights are removably retained inside the sleeve. It will be apparent that the threaded surfaces of connections 30 and 32 can be reversed whereby sleeve 28 can be received inside the leg 24*a* and whereby cap 34 can thread into the upper end of the sleeve in the manner of a plug. Moreover, the leg, sleeve and cap components could be made so that, when threadably assembled, their exterior diameters would be uniform thereby presenting a one-piece appearance and reducing, accordingly, the chance of impacting the sleeve or cap in such a manner that either might be inadvertently loosened or detached.

From the foregoing description, it will be understood that a sleeve 28 may be threadably assembled upon each of the legs 24*a*, 24*b* to define at the distal ends thereof a pair of cylindrical receptacles 36 projecting outwardly from the U-shaped head 14 in parallel alignment with one another and with the longitudinal centerline of the handle 12. The purpose of the receptacles 36 is the reception and retention of a selected amount of weight for the dual purposes to be described hereinafter. It will also be seen that the weight carried by the receptacles may be provided by bodies having variable shapes, sizes and densities.

The weights 40*a* through 40*d* carried interiorly of the receptacle 36 shown in FIG. 3 comprise a plurality of cylindrical discs having the same outside diameter which permits their insertion into receptacle 36 in freely sliding contact with the interior wall of sleeve 28. The close fit between the cylindrical walls of the discs and the sleeve guides the weights into the sleeve and permits the sleeve to retain the discs against unwanted radial movement. A stabilizer spring assembly indicated in its entirety by numeral 38, is disposed within the receptacle 36 and is axially captured between the-extreme upper end surface of the threaded portion of leg 24*a* and the circular bottom surface of the innermost weight disc 40*a*. Spring assembly 38 comprises a coiled compression spring 42 having its opposite ends engaged by disc-like inner and outer spring followers 44*a* and 44*b* respectively. The followers have reduced diameter bosses 46*a*, 46*b* which interfit with the terminal coils forming the opposed ends of spring 42. Follower 44*b* abutts the extreme end surface of leg portion 24*a* to form a base or bottom wall for the receptacle 36. Follower 44*a* lies immediately subjacent disc 40*a* and provides an underling support for all of the vertically stacked discs 40*a* through 40*d*. FIG. 3 shows that the thicknesses of the 40*a*, 40*b*, 40*c* and 40*d* is graduated downwardly; and, since this embodiment anticipates that all of the discs are solid and of uniform density, the individual weights of these discs are likewise reduced.

It will be understood that a number of discs 40*a* through 40*d* of the same or different thicknesses, or even a single disc if of sufficient thickness, may be compressively captured between the spring follower 44*a* and the inner or bottom surface of the closure cap 34 which bears downwardly upon the uppermost disc 40*d*. In the illustrative weight assembly 26*a*, one disc 40*a*, three discs 40*b*, two discs 40*c* and one disc 40*d* have been deposited serially into the sleeve. The total axial dimension of these stacked discs is somewhat greater than the vertical distance between the bottom of cap 34 when fully threaded on to the free end of the sleeve and the top surface of spring follower 44*a* previous to compressive shortening of spring 42 in the manner shown in FIG. 3. Once all of the discs are pressed inwardly into the sleeve 28 and the cap 34 is drawn down against disc 40*d*, the spring 42 will be compressed and will thereafter exert an outwardly or upwardly directed biasing force against the stacked discs. In this manner, the discs are resilently, but forcefully captured between the cap 34 and the spring 42 and can not shift axially in an unconstrained and perhaps deleterious fashion even though the weight receptacle 26*a* may have substantial inertial and/or shock forces applied to it in normal use.

Turning to a second embodiment of the invention illustrated in FIG. 4, a different weight assembly, indicated in its entirety by numeral 26*c*, utilizes as a weight receptacle a hollow cylindrical sleeve 48 which is an intergral extension of the tubular segment 24*a* of the head 14. A transverse member 50, which may take the form of a double headed rivet, extends diametrically across the sleeve 48 to provide a fixed lower support for a stabilizer spring assembly 52 which is structurally and operationally similar to stabilizer spring assembly 38 described above in connection with the FIG. 3 embodiment. A spring 54 is captured between spring follower discs 56*a* and 56*b*, respectively, with follower 56*a* abutting transverse member 50 while the follower 56*b* is urged upwardly against the lowermost weight disc. A plurality of weight discs, two of which are shown at 58*a* and 58*b*, are spring biased against one another in stacked relationship with one or more overlying discs, not shown. The uppermost disc of the stack bears against a closure cap 60 threadably attached to sleeve 48 in like manner as cap 34, shown previously in FIG. 3, is attached to sleeve 28. The cylindrical discs 58*a*, 58*b* are annular rather than solid and provide less weight per disc than the previously described discs 40*c*, for example, which have approximately the same diameter and thickness. However, any additional weight carried between disc 58*b* and closure cap 60, may comprise a single annular cylinder or even multiple solid cylinders, as desired. The axial dimension of the stacked weight discs depicted in FIG. 4 is substantially less than that of discs 40*a* through 40*d* shown in the FIG. 3 embodiment, therefore, the degree of compression, hence axial shortening, of spring 54 is less than that of equivalent spring 42. Nevertheless, the reactive spring bias acting upwardly against the discs captured between follower 56*a* and retainer cap 60 will effectively stabilize the discs against unrestrained axially movement which could produce annoying rattling, increased wear on parts of the weight assembly, or the possibility that the retainer cap might be loosened or fractured. The cap 60 is provided with lands and grooves to enhance the user's gripping thereof for cap tightening or loosening; and, any other of-the closure means described herein could be provided with the same or equivalent enhancements.

The absense of a discrete sleeve in the FIG. 4 embodiment makes it simpler and somewhat less expensive to fabricate since the need for a sleeve attachment joint is obviated. The somewhat smaller diameter of sleeve extension 48 over sleeve 28, the possible use of lightweight plastic or wooden spring followers 56*a*, 56*b*, and annular rather than solid weight discs 58*a*, 58*b* renders the aggregate weight of assembly 26*c* somewhat less than that of the aforedescribed assemblies 26*a* and 26*b* and dramatically less in weight than the alternative weight assemblies illustrated in FIGS. 5 and 6.

While the capacity of weight assemblies 26*a* and 26*c* made according to FIG. 3 and FIG. 4, respectively, could be increased by further elongation of their respective sleeves 28 and 48, a simulant racket 10 having weight assemblies projecting outwardly from the head 12 substantially beyond the position shown in FIGS. 1 and 2 would be unwieldy. Moreover, a substantially greater extension of the head 14, or of the weight assemblies attached thereto would deprive the simulant racket of any vestigial feel or appearance of a playable racket which some users might find desirable.

In order that the benefits and advantages of this invention may be actualized where the simulant racket must be more heavily weighted than is practically achievable by using the just described FIG. 3 and FIG. 4 embodiments, the weight assemblies shown in FIG. 5 and FIG. 6 have been modified in various ways to accept a greater aggregate amount of weight to satisfy this need. Looking first at the device depicted in FIG. 5, a weight assembly, indicated in its entirety by numeral 26*d*, includes an enlarged cylindrical housing 64 sized to receive and retain therein weight discs 66*a* through 66*c* which are approximately twice the diameter of the discs disposed in weight assemblies 26*a* and 26*c*. These larger and heavier discs may be graduated in thickness as are the previously described weights 40*a* through 40*d* in order that the total weight contained in the assembly 26*d* can be selectively varied over a substantial range. The discs 66*a*, 66*b*, and 66*c* are received in the housing 64 in axially stacked relation between resilient stabilizer discs 68*a* and 68*b*. A nonmetallic spacer or dummy disc 70 may be interposed between weight disc 66*c* and the upper stabilizer disc 68*b* or between any adjacent discs for a purpose to be disclosed.

To accommodate the vastly increased size and weight of housing 64 yet provide for its attachment to the distal end of portion 24*a* of head 14, a cylindrical boss 72 is formed with or attached to the bottom housing wall 64*a* by welding or by a-like process. The interior wall of the boss 72 and exterior wall of leg end portion 24*a* are provided with complementary threads which are engagable to provide a strong joint 74 between the housing 64 and the head 14. An elongated shaft 76 concentric with the housing 64 extends coaxially upwardly through the housing bottom wall 64*a* beyond the extreme upper end surface 78 of housing 64. The shaft 76 has an enlarged, flattened head 80 which is suitably secured to the bottom wall 64*a* to prevent relative axial or rotary movement between these parts. The shaft 76 axially penetrates aligned central apertures in the stablizer discs 68*a*, 68*b*, the weight discs 66*a*, 66*b* and 66*c*, the dummy disc 70 and an inverted closure cap 82 overlying the open upper end of housing 64. A cylindrical nut 84 engages the top surface of cap 82 and has a threaded central recess 86 which receives mating threads formed on the protruding upper end of shaft 76 to form a joint 88.

After the discs shown in FIG. 5 are loaded into the housing 64, the closure cap 82 is pressed downwardly over the stabilizer disc 68*b* so that the threaded end of the shaft 76 projects visibly through the cap. The nut 84 is then attached to the shaft 76 to draw the cap forcibly into compressive engagement with the resilient disc 68*b*. Before the bottom surface of the cap 82 engages the upper annular surface 78 of the housing, the two stabilizer discs 68*a* and 68*b* will be elastically deformed and will impart an axial bias to both ends of the disc stack sufficient to prevent axial movement relative to the shaft 76. The function of disc 70 is to position the upper stabilizer disc 68*b* above the housing end surface 78 to insure sufficient axial compression of the discs 68*a*, 68*b* for performance of their stabilizing function. One or more dummy discs may be included in a stack of discs to reduce the aggregate weight of a weight assembly.

As will be seen in FIG. 5, this heavier embodiment is mounted on a racket head which is made of solid rod material for increased strength. It will also be appreciated that the discs retained in the housing 64 are made of divergent materials having different characteristics suitable to their functions. Accordingly, the stabilizer discs may comprise a high-durometer elastomer, the spacer 70 may be made of relatively incompressible plastic, and the weight discs 66*a*, 66*b* and 66*c* may be made of metals having different densities, such as steel, aluminum or lead, for example.

Figure 7:
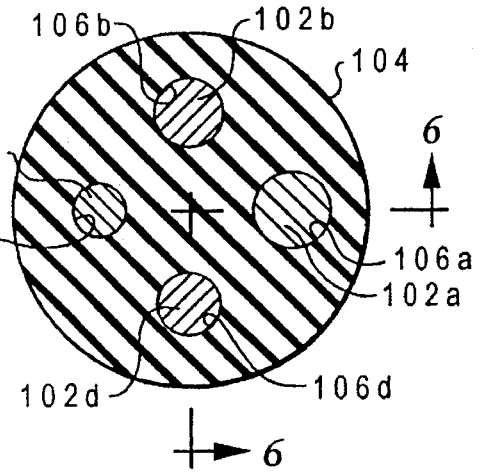
FIG. 7 is a transverse section taken generally along lines 7—7 of FIG. 6.

FIGS. 6 and 7 illustrate yet another preferred embodiment of this invention wherein a weight assembly 26*e* includes an enlarged cylindrical housing 92 similar in configuration and volume to housing 64 described in connection with FIG. 5. A cylindrical boss 94 is attached to the bottom exterior surface 96 of housing 92 by welding, for example; and, the solid distal end 24*a* of leg 20*a* is received in the boss 94 and rigidly secured thereto by means of welding, brazing, adhesive or the like. A threaded connection 98 is provided to secure a closure cap 100 to the free end of the housing 92. A set of headed cylindrical weights are carried within the housing 92 and provides means for adjusting the contained weight of the assembly 26*e* by removing one or more of the weights, as desired.

The means for retaining and stabilizing the weights 102*a* through 102*d* inside housing 92 is of necessity substantially different from that employed in the previously described weight assemblies 26*a*, 26*c* and 26*d* due to the elongated shape and vertical orientation of these weights. To this end, a cylindrical elastomeric block 104 is pressed into the housing 92 and is thereafter axially retained in the housing due to the elasticity of the block. As best illustrated in FIG. 7, the block 104 is provided with elongated cylindrical chambers 106*a* through 106*d* for receiving the weights 102*a* through 102*d* which are made progressively smaller in diameter. The chambers are radially spaced about the axis of the block and open at the extreme upper end surface 108 of the block. Each of the chambers has a diameter which is somewhat less than that of its associated weight so that pressing the weight into its chamber will cause the block 104 to embrace the weight elastically and retain it against unintended longitudinal displacement. To facilitate digital grasping of the weights, each is provided with a flared head portion, as seen at numerals 110*a* through 110*c*, which projects longitudinally from the block 104 beyond the block end surface 108. The flat upper surface of each head may bear a readily visible indication of cylinder weight to assist a user in placing an appropriate total weight in assembly 26*e*. In this regard one or more of the weights may be removed; and, weights of different densities may be placed in the chambers 106*a* through 106*d*.

Having described the several preferred embodiments of the invention in detail, it will be appreciated that each meets the structural and functional objectives set forth above. However, it should be understood that features peculiar to one of the embodiments may be advantageously employed or interchanged with another. For example, any of the assemblies 26*a*, 26*d* and 26*e* could be alternatively fastened to a solid or a tubular head 14 by either a threaded attachment or by a non-detachable welded joint. Also the spring assemblies 38 and 52 and the elastomeric stabilizer discs 68*a*, 68*b* could be appropriately modified for use with other of the weight assemblies 26*a*, 26*c* or 26*d*.

OPERATION AND METHOD OF USE OF THE INVENTION

As shown in FIG. 1, the simulant racket 10 is intended to be grasped about the grip 16 for manipulation by the hand, wrist and arm of a user just as are all of the previously cited prior art devices intended for the same purpose. Although the complex physiology of the human arm cannot be adequately and accurately represented herein in a totally diagrammic fashion, FIG. 1 illustrates, in a limited but fundamental way, the physics involved in the use of racket 10.

The wrist may be considered a horizontal pivot P about which the aggregate weight $W_1$ of the racket 10 and weight assemblies 26*a* and 26*b* acts through their center of gravity CG at a distance $D_1$ from pivot P to create a counterclockwise movement $M_1$. To enable the user to maintain the racket in the depicted horizontally extended position, the user's hand must impart a lifting force F to the racket grip 16 at a distance $D_2$ from P which will produce a clockwise movement $M_2$ sufficient to maintain the racket in rotational equilibrium about pivot P. If additional weight were added to the racket head 14 by increasing the size, number or density of the weights contained in the weight assemblies 26*a*, 26*b*, $M_1$ would then exceed $M_2$, and, accordingly, the user would be required to exert additional muscular effort sufficient to equalize these moments in order to prevent his hand and the racket from pivoting downwardly. While actual usage of the simulant racket probably will not require that the user merely maintain the condition of static equilibrium just described, what is made clear by reference to FIG. 1 is that the described muscular stressing and any consequent increase in muscle strength resulting therefrom is directly related to the amount of weight $W_1$ acting at the center of gravity of the racket head 14. This applies whether the racket is stationary or dynamic and no matter which of many hand, wrist and arm muscles are involved in a particular exercise or practice stroke.

Having the above in mind, a user, coach or trainer can preselect a racket weight $W_1$ that is appropriate for merely loosening muscles and joints, for manipulation of the racket to practice and perfect certain basic strokes, or for strenuous dynamic musclar activity that is ultimately productive of increased racket speed and ball impacting force.

An especially advantageous feature of the abovedescribed simulant racket 10 resides in its ability to provide a heretofore unavailable range of weight that in turn expands its useful applications well beyond that of ordinary exercise and muscle developing rackets. Thus the embodiments herein described include weight assemblies having widely adjustable weight capacities ranging upwardly from the lighter capacities of the FIG. 3 and FIG. 4 housings to the heaviest possible capacity shown in FIG. 5. Since these several weight assemblies could be interchangeably attached to the racket legs 20*a*, 20*b*, only one racket frame if required to realize the full range of weights available from this invention. Moreover, each of the weight assemblies can be loaded to its maximum weight or to a desired lower weight simply by including fewer of the incrementally sized weight discs or cylinders, with or without substitution therefor of lightweight spacers. The disclosed embodiments suggest several ways to employ the graduated weights in different combinations to adjust racket weight $W_1$ with precision. This range of weight adjustment and ease of weight adjustment are particularly valued by trainers who may wish to increase periodically the weight of a simulant racket as a user's skills and strength develop from those of a novice to those of an advanced amature or even a professional player. Obviously, where several students are being trained at different levels of physical development, rapid and substantial weight adjustment for each of a plurality of rackets 10 is essential.

Another important aspect of this invention is the provision of a simulant racket which may be beneficially employed in teaching or training players to sense the angular position of the racket head 14 with respect to vertical. This novel and surprising capability of racket 10 will be understood by having reference to FIGS. 8 and 9 of the drawings.

Figure 8:
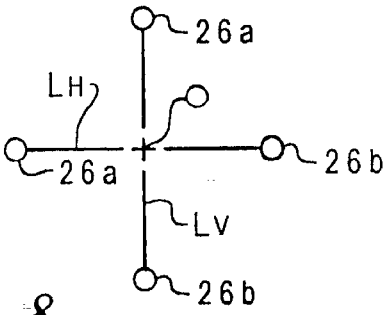
FIG. 8 is a diagrammatic view showing alternately the weight assemblies of FIG. 1 rotated between horizontally and vertically aligned positions; and, FIG. 9 is a diagrammatic view depicting the weight assemblies shown in FIG. 1 rotated somewhat from their vertically aligned condition depicted in FIG. 1 and FIG. 8.

In FIG. 8, which is diagrammatic only, the longitudinal centerline and rotational axis of the racket handle and head are indicated at letter O; and, the vertical orientation of head 14 is represented by a vertical line $L_v$ connecting equally weighted assemblies 26*a* and 26*b*. The horizontal line $L_h$ connecting the assemblies 26*a* and 26*b* represents the head 14 when it is horizontally oriented about axis O. Rotation of head 14 about axis O, with a corresponding change in angular position of the weight assemblies from vertical to horizontal, will not change the racket weight W or vary the muscular force F required to prevent the player's wrist and hand from bending vertically downwardly about pivot P. Since assemblies 26*a* and 26*b* are of equal weight and their moment arms about axis O are radii of a circle described by the movement of these weights, the simulant racket 10 will be in a condition of neutral equilibrium about axis O no matter what the angular orientation of these assemblies may be.

Figure 9:
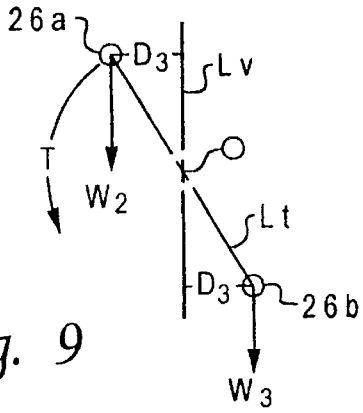

Should, however, the weights $W_2$ and $W_3$, shown in FIG. 9, be purposely made unequal, say by incrementally increasing the weight of assembly 26*a* by some appropriate means disclosed herein, counterclockwise rotary deviation of the head 14 about racket axis O from its vertical orientation $L_v$ to that represented in FIG. 9 by line $L_t$ will create an unstable rotary condition which can be represented by a summation of moments about axis O wherein $(W_2 \times D_3)-(W_3 \times D_3) \neq 50$. The unbalanced moment $W_2 \times D_3$ produces a counterclockwise torque T which, if head 14 were rotationally unconstrained, would force the racket 10 counterclockwise about its longitudinal axis O. Obviously, the greater the angular deviation of head 14 from vertical, up to 90 degrees of deviation, the greater will be the resultant torque T acting to rotate the head of the simulant racket downwardly away from its vertical orientation represented by line $L_v$.

It will be appreciated that a user having the racket 10 grasped in his hand in the manner shown in FIG. 1 will feel a torque T, depicted diagrammically in FIG. 9, tending to rotate his hand, wrist and forearm counterclockwise about some line extending generally horizontally through his forearm in approximate alignment with the longitudinal axis of the racket handle 12. Although the actual alignment of the handle and forearm axes may not be exact, the forearm and wrist may be thought of as having a continuous rotary axis about which torque T created by deviation of the racket head 14 from vertical will twist or otherwise stress those muscles, tendons and joints of the user's hand, wrist and arm which are necessary to sustain the racket head 14 in a more or less vertical condition.

From the foregoing it will be understood that by placing unequal amounts of weight in weight assemblies 26*a*, 26*b* carried by the legs 20*a*, 20*b* of the head 14, the user's arm will be subjected to and will detect torque produced by deviation of the head in either direction from vertical. More importantly, perhaps, the user will sense less torque as the head is brought more nearly vertical and no torque at all when verticality is achieved. In the last circumstance, i.e. no perceived torgue the only arm stress imparted to and perceived by the user will be that created as aforedescribed by weight $W_1$ tending to pull the racket downwardly about the wrist pivot P.

One important factor affecting the development of a psychomotor skill, such as the ability to maintain the head of a tennis racket vertically and to cue certain desired angular deviations of the racket head from a remembered vertical condition, is psychological feedback, i.e. knowledge of achieved results, that occurs concurrently with or soon after the user's successful effort to adjust the racket head in an appropriate manner. Accordingly it is believed that the present invention, when configured and weighted in the unequal manner described above in reference to FIG. 9, provides such supportive feedback of sensory information in the form of kenesthetically perceived and measured reactions to the presence or absence and to the increase or decrease of torque related arm stress due to any deviation from vertical of the racket head 14.

A tennis trainer or coach will readily appreciate the above-noted feedback factors made available by this invention for inclusion in a superior method for developing a tennis player's skills relevant to racket positioning and manipulation while at the same time the player is acquiring increased muscular strength and racket speed through use of the simulant.

The foregoing description of the embodiments of the invention shown in the drawings is illustrative and explanatory only; and, various changes in the size, shape and materials, as well as in specific details of the illustrated construction, may be made without departing from the scope of the invention. Therefore, I do not intend to be limited to the details shown and described herein, but intend to cover all changes and modifications which are encompassed by the scope and spirit of the appended claims.

What we claim as our invention is:

1. A simulant weighted sports racket, including:

a) elongated handle means;

b) head means joined to said handle means;

c) said head means comprising divergent legs terminating in laterally spaced end segments;

d) weight attachment means joined to said end segments of said legs;

e) weight means removably secured to each of said end segments by said attachment means;

f) said weight attachment means includes hollow housings; and, g) said weight means are disposed in said housings.

2. The invention set forth in claim 1, wherein:

said weight attachment means are detachably joined to said end segments.

3. The invention set forth in claim 2, wherein:

said weight attachment means and said end segments are joined by threaded connections.

4. The invention set forth in claim 3, wherein:

said weight attachment means are interchangeable with other weight attachment means of different weight carrying capacities by means of threads formed on said end segments and on said other attachment means.

5. The invention set forth in claim 1, wherein:

said housings comprise integral extensions of said legs.

6. The invention set forth in claim 1, together with:

a) resilient stabilizer means disposed within said hollow housings to prevent displacement of said weight means relative to said hollow housings.

7. The invention set forth in claim 6, wherein:

said stabilizer means comprises a compression spring.

8. The invention set forth in claim 6, wherein:

said stabilizer means comprises at least one elastomeric disc abutting said weight means.

9. The invention set forth in claim 6, wherein:

said stabilizer means comprises an elastomeric block having plural chambers sized for receiving and retaining said weight means.

10. A simulant weighted sports racket, including:

a) elongated handle means;

b) head means joined to said handle means c) said head comprising divergent legs terminating in laterally spaced end segments;

d) weight attachment means joined to said end segments of said legs; and, e) plural weight means removably secured to of said end segments by said attachment means.

11. The invention set forth in claim 10, wherein:

said weight means are graduated in weight.

12. The invention set forth in claim 11, wherein:

said weight means comprise stacked metallic discs.

13. The invention set forth in claim 10, wherein:

said weight means comprise elongated metallic cylinders retained in said housing in radially spaced relationship.

* * * * *

UNITED STATES PATENT AND TRADEMARK OFFICE

CERTIFICATE OF CORRECTION

PATENT NO. : 5,593,155

DATED : 01-14-97

INVENTOR(S) : C. Fauble & D. Fauble

It is certified that error appears in the above-indentified patent and that said Letters Patent is hereby corrected as shown below:

Column 11, line 43, after "≠", delete--5--.

Claim 10, Column 14, line 6, after "(e) plural weight means removably securred to" insert --each--.

Signed and Sealed this

Twenty-ninth Day of April, 1997

*Attest:*

*Attesting Officer*

BRUCE LEHMAN

*Commissioner of Patents and Trademarks*